United States Patent [19]

Ballard, Jr.

[11] 4,442,874

[45] Apr. 17, 1984

[54] AUTOMATIC VALVE BAG PLACER

[75] Inventor: Jack V. Ballard, Jr., Morristown, N.J.

[73] Assignee: John L. Macfarlane, Modesto, Calif.

[21] Appl. No.: 389,410

[22] Filed: Jun. 17, 1982

[51] Int. Cl.[3] ..... B65B 1/00

[52] U.S. Cl. ..... 141/166; 53/384; 271/12

[58] Field of Search ..... 53/384, 386, 571; 141/9, 10, 68, 83, 114, 154, 166, 281, 313, 314, 144, 315, 316, 317, 392; 271/12, 102, 165, 166, 217; 414/121, 128

[56] References Cited

U.S. PATENT DOCUMENTS

| | | | |
|---|---|---|---|
| 900,782 | 10/1908 | Richards | 271/12 |
| 2,382,405 | 8/1945 | Eckman | 414/128 X |
| 2,984,480 | 5/1961 | Cunningham | 271/12 X |
| 3,213,588 | 10/1965 | Peterson | 141/10 |
| 3,423,903 | 1/1969 | Miller, Jr. | 53/571 |
| 3,503,606 | 3/1970 | Castellanet | 271/166 |
| 3,676,977 | 7/1972 | Rothmann et al. | 53/437 |
| 3,691,715 | 9/1972 | Kelly et al. | 53/459 |
| 3,715,858 | 2/1973 | Durant et al. | 53/573 |
| 3,884,278 | 5/1975 | Nakashima | 141/67 |
| 3,887,177 | 6/1975 | Farfaglia et al. | 271/102 X |
| 3,991,997 | 11/1976 | Barber | 414/121 X |
| 4,043,551 | 8/1977 | Morrison et al. | 271/12 X |
| 4,128,116 | 12/1978 | Uthoff et al. | 141/1 |
| 4,141,392 | 2/1979 | Moltrasio | 141/98 |
| 4,154,438 | 5/1979 | Seragnoli | 271/12 |
| 4,158,943 | 6/1979 | Lack et al. | 53/459 |
| 4,213,212 | 7/1980 | Hefty et al. | 4/243 |

FOREIGN PATENT DOCUMENTS

| | | | |
|---|---|---|---|
| 2627304 | 12/1977 | Fed. Rep. of Germany | 141/166 |
| 197804 | 4/1978 | France | 141/166 |
| 554,905 | 7/1943 | United Kingdom | 414/128 |

*Primary Examiner*—Stephen Marcus
*Assistant Examiner*—Mark Thronson
*Attorney, Agent, or Firm*—Manfred M. Warren; Robert B. Chickering; Glen R. Grunewald

[57] ABSTRACT

An automatic valve bag placer is disclosed which is constructed to sequentially remove valve bags from a bag magazine, manipulate the end flap of the bag for opening, open the valve and place the same on a fill spigot. An improved bag magazine and feeding assembly in which a plurality of trays are mounted on the elevator and feed stacks of limited number of bags onto a pick-off support structure ensures that bags are picked off one by one. The bag is oriented by a horizontal and then a vertical conveyor to a near vertical orientation, which orientation is retained thereafter until the bag is placed on the fill spigot. A pair of carriages and associated clamping means first pass the bag through a deflector assembly to orient the valve for opening, and then, after opening, the second carriage carries the bag to and inserts the same over the fill spigot.

15 Claims, 13 Drawing Figures

AUTOMATIC VALVE BAG PLACER

BACKGROUND OF THE INVENTION

A wide variety of products are conventionally packaged in bulk in relatively large bags which are formed with valve means in one of the end flaps of the bag. Such bags, referred to in the industry as "valve bags" or "valved bags," are usually formed of a heavy paper, but sometimes they are formed of plastic material or include a plastic liner. The valve in these bags is constructed so that it can be opened to permit a fill spigot to be positioned inside the valve opening, either by moving the bag over the spigot or the spigot into the bag. Once filled, the material inside the bag tends to flatten the end flap and automatically close the valve against accidental discharge of material from the bag.

Numerous apparatus have been developed for the automatic, sequential opening of valve bags and positioning or placing of the same on the fill spigot. Typical of such apparatus are the devices set forth in the following U.S. Pat. Nos.: 3,213,588, 3,423,903, 3,676,977, 3,691,715, 3,715,858, 3,884,278, 4,128,116, 4,141,392, 4,158,943 and 4,213,212. Valve placer apparatus such as the devices set forth in the preceeding patents generally include a bag magazine, a feeding assembly which removes bags from the magazine and feeds them sequentially to an assembly formed to orient the bag and the end flap containing the valve, a bag opening assembly formed to open the valve after orientation of the same, and a bag filling assembly formed to fill the bag through the fill spigot.

While prior art automatic bag placers have included all of the necessary assemblies for automatically feeding bags to a fill spigot, considerable problems have been encountered in connection with reliable operation of such apparatus. Thus, prior bag storage magazines have been constructed in a manner which causes multiple bags to be withdrawn from the magazine, instead of a single bag. Bag feeding and orienting assemblies have not reproducibly manipulated the bags and valves to enable opening of the same. Bag opening and filling assemblies have not reproducibly opened and positioned the open bag on the fill spigot. Additionally, such bag placer apparatus tend to be undesirably complex in structure and slow in operation.

OBJECTS OF THE INVENTION

Accordingly, it is an object of the present invention to provide an automatic valve bag placer which has improved reliability, speed of operation, and simplicity of components.

Another object of the present invention is to provide a bag feeding assembly for a valve bag placer or the like which is capable of sequentially feeding valve bags to bag manipulating apparatus without jamming or double feeding of bags.

Another object of the present invention is to provide a bag feeding assembly for a valve bag placer or the like which can be readily adjusted to accommodate bags formed of various materials and of various sizes.

Another object of the present invention is to provide a deflector assembly for use in an automatic valve bag placer which is capable of quickly orienting or manipulating the end flap of the valve bag so that the valve can be easily opened.

Still another object of the present invention is to provide an automatic valve bag placer in which the bag manipulating functions are sequenced together with maximum efficiency in the transfer from one bag manipulating step to another.

Another object of the present invention is to provide an automatic valve bag placer which is durable, economical to construct, requires only one operator, can be easily maintained, is relatively compact in structure.

The automatic valve bag placer of the present invention has other objects and features of advantage which will become apparent from and are set forth in more detail in the accompanying drawing and the following description of the preferred embodiment.

SUMMARY OF THE INVENTION

The automatic valve bag placer of the present invention includes a flap orienting assembly formed for rotation of the end flap of a valve bag to position the valve for opening, a bag feeding assembly formed to feed individual bags sequentially to the orienting assembly, a bag opening assembly formed to open the bag after orientation, and a bag filling assembly formed to fill the open bag. The improvement in the automatic valve bag placer of the present invention is comprised, briefly, of a feeding assembly which includes a vertical conveyor formed for conveyance of bags to the flap orienting assembly and for removal of the bags from the side thereof, a flap orienting assembly having a first clamp and first carriage formed for lateral displacement of the bag out of the vertical conveyor and against deflector means to rotate the end flap for opening of the valve, and a bag opening and filling assembly including a second clamp means and second carriage means formed to grip the bag immediately below and proximate the end flap to enable opening of the bag and transfer of the bag in an open condition to a bag filling spigot.

In another aspect of the present invention, a bag feeding assembly for a bag placer is provided which includes a pick-off station proximate the lowermost bag of a stack of horizontally oriented bags with support means positioned at said station and formed to define an opening through which the lowermost bag may be pulled down away from the horizontal stack. The bags are preferably stacked in a plurality of trays mounted to a conveyor which deposits the stacks sequentially on the support surface so that the height of any stack on the support surface is limited.

In a further aspect of the present invention an improved deflector assembly is provided which is formed to first rotate the uppermost portion of the end flap of the bag downwardly and to thereafter rotate the lowermost portion of the end flap upwardly until the end flap is oriented at about 90° to the bag body. This is accomplished while the bag body is in near vertical orientation.

Finally, a side-opening vertical conveyor for feeding the bag orienting deflector is provided in which the bag can be vertically oriented by the conveyor and thereafter laterally displaced from the conveyor to the fill spigot while flap orienting and bag opening operations are accomplished.

DESCRIPTION OF THE PREFERRED EMBODIMENT

Figure 1:
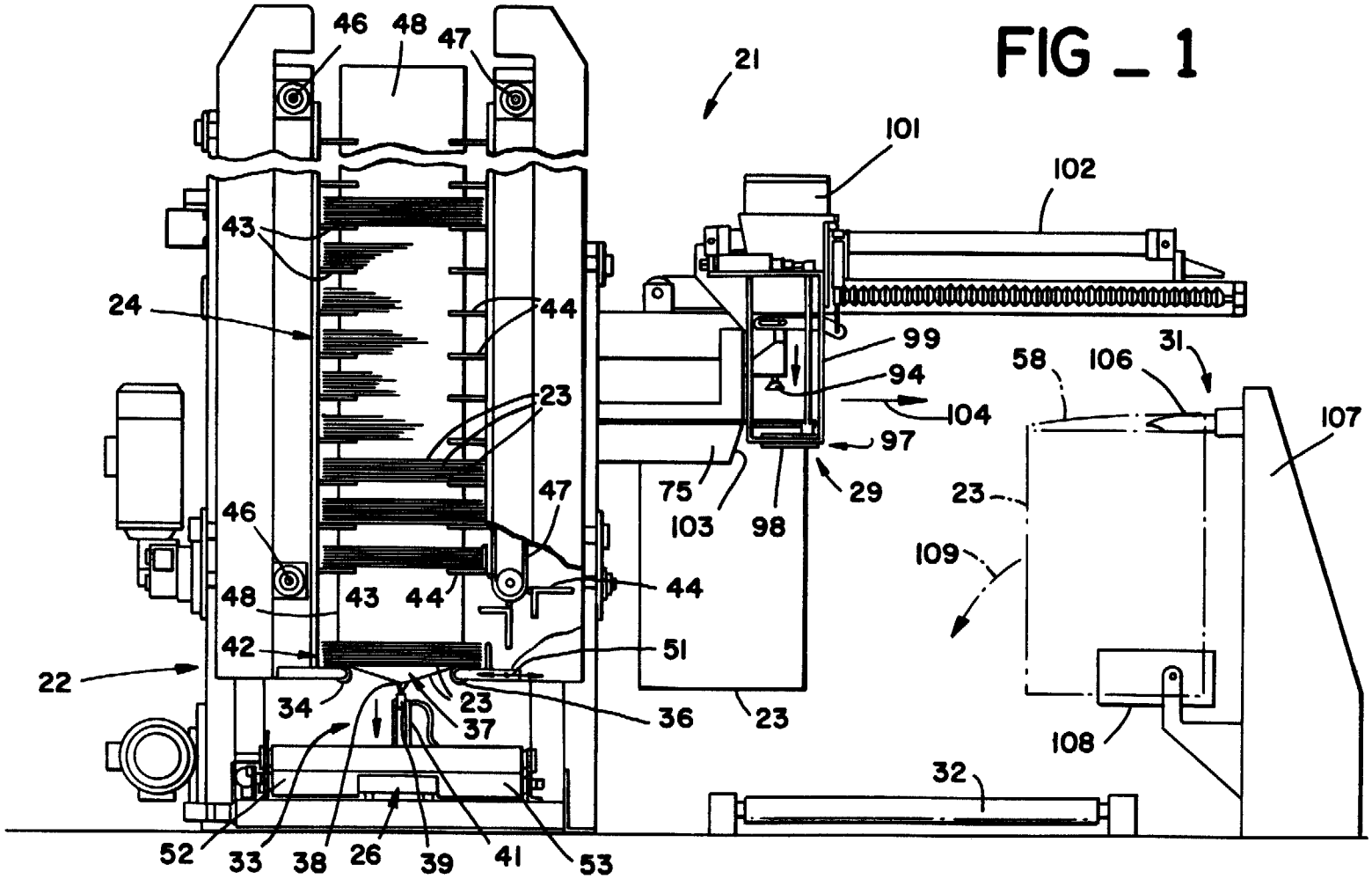
FIG. 1 is an end-elevational view, partially broken away, of an automatic valve bag placer constructed in accordance with the present invention.

The automatic valve bag placer of the present invention includes various assemblies which are broadly shown in prior art apparatus. Thus, valve bag placer 21 includes a bag feeding assembly, generally designated 22 in which valve bags 23 are removed from a bag magazine 24 and fed by means of horizontal conveyor 26 and vertical conveyor 27 to an end flap orienting assembly, generally designated 28. From the end flap orienting assembly, the bag valve is opened at a bag opening assembly 29 and thereafter transferred to a filling assembly or station 31. Once the bag is filled, it is deposited on conveyor 32 for transfer to storage or transportation facilities.

Referring now to FIGS. 1 through 6, the details of construction of the bag feeding assembly of the automatic valve bag placer apparatus of the present invention can be set forth. In order to reduce the incidence of double feeding and failure to feed, the automatic bag placer of the present invention has an improved bag magazine 24 and pick-off means, generally designated 33. Bag magazine 24 is formed for stacking of a plurality of valve bags in a generally horizontal orientation and includes support means, such as support rollers 34 and 36, positioned proximate the bottom of the magazine and formed with an opening 37 therebetween for removal of valve bags from the magazine by pick-off means 33. Thus, horizontal stack 42 of valve bags 23 is supported by rollers 34 and 36 which engage the periphery of the lowermost bag and provide a pick-off station or opening 37 through which valve bags can be pulled by pick-off means 33.

In order to prevent the weight of the valve bags from interferring with pulling of the lowermost bag off of the stack, it is further preferable that the bag magazine include a plurality of movable bag support trays each formed receipt of a stack of a predetermined number of bags. As shown, the trays are provided by flanges 43 and 44 which are positioned in pairs and mounted on conveyor means 46 and 47, respectively. Conveyors 46 and 47 are coupled for synchronous controlled movement, and as will be seen in FIG. 1, flange means 43 and 44 will pivot down around the lowermost conveyor support pulley to allow the stack held by the conveyors to drop down onto support rollers 34 and 36. This construction limits the number of bags in any stack positioned on the support rollers and therefore limits the gravitationally induced friction force of the weight of the stack on the lowermost bag so that the pick-off means 33 can reliably pull only the lowermost bag up from under the stack through opening 37. In fact, the weight of the stack to some degree tends to bow the bags downwardly at the middle of opening or pick-off station 37 to enhance removal of the bag off of the bottom of the stack.

In order to accommodate bags of various widths and lengths, it is preferable that at least one of endless conveyors 46 and 47 be mounted to the magazine frame for displacement toward or away from the remaining conveyor. This provides a width adjustment in addition to the inherent range of widths which flanges 44 will support. Similarly, it is preferable to provide the apparatus of the present invention with a movable length adjustment panel 48, which can be selectively adjusted in the direction of arrow 49 in FIG. 2 to position the bags longitudinally in the trays of the bag magazine in the desired location, depending upon the bag length.

Valve bags are formed of a variety of different materials. Most bags are formed of heavy paper, but some are formed of plastics or include a plastic liner. Accordingly, the ability of support rollers 34 and 36 to support the bags a pick-off station 37 without allowing the same to fall down through the opening will vary from bag construction to bag construction. Accordingly, it is preferable that the support surfaces are mounted for selective lateral displacement to enable changing of the distance between them, as indicated by arrows 51 for support roller 36. The spacing between the support rollers, therefore, can be selected so as to minimize the force required to pull the bags down between the rollers and yet support a stack of bags which will vary from one bag to typically about 25 bags.

As best may be seen in connection with FIGS. 2 through 6, vacuum cup pick-off assembly 33 preferably includes a pair of spaced apart vacuum cups 38 which are mounted to a longitudinally extending vacuum manifold 39 carried on upwardly displaceable arms 41. Conveyor 26 is preferably formed as a pair of spaced apart side-by-side conveyor belts 52 and 53 (FIG. 1) with retractable arms 41 positioned therebetween. As arms 41 lower manifold 39, the manifold is maintained in a horizontal orientation and retracted to a position below belts 52 and 53, as best may be seen in FIG. 6. Bag 23 will span across and rest on the two side-by-side conveyor belts. The vacuum in cups 38 can then be broken with the result that the bag will move forward in the direction of arrow 54 to the bag opening and positioning apparatus of the valve bag placer.

Figure 3:
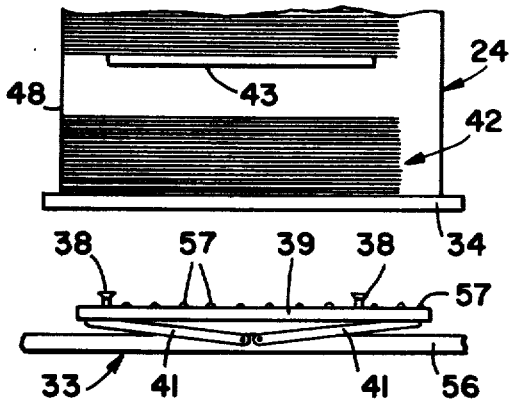
FIGS. 3 through 6 are fragmentary, side-elevational views of the bag pick-off assembly of the present invention.
Figure 4:
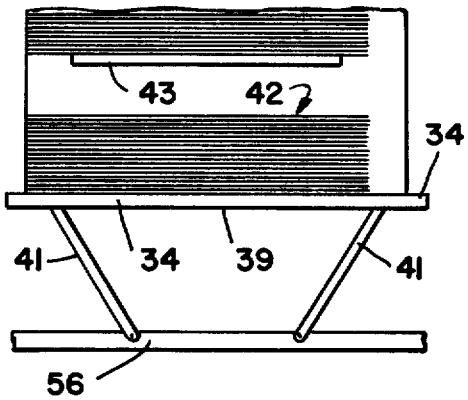
Figure 5:
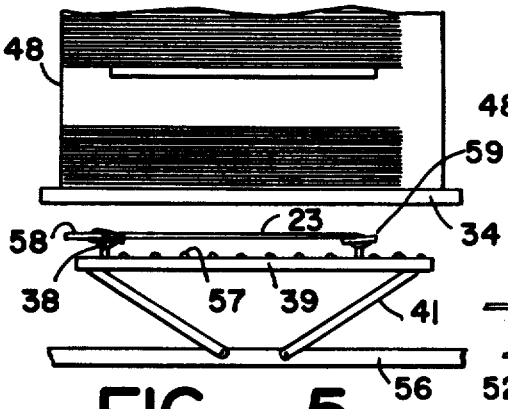
Figure 6:
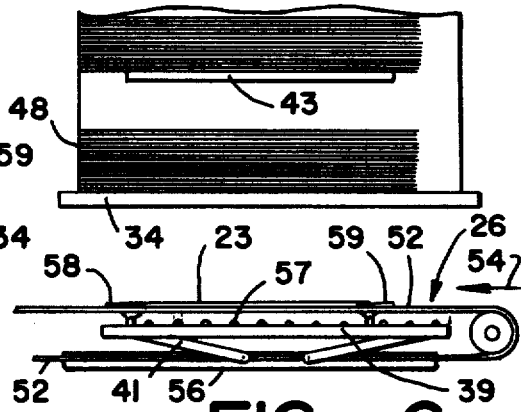

The sequence of operation of vacuum pick-off assembly 33 can be seen in FIGS. 3 through 6. In FIG. 3 arms 41 are fully retracted on base 56, and the conveyor 26 is not shown for simplicity of illustration. In FIG. 4 arms 41 are extended until vacuum cups 38 engage the lowermost bag in stack 42. A vacuum is then applied to vacuum grip bag 23, and arms 41 are retracted until the bag is pulled down between the support rollers 34 and 36, as shown in FIG. 5. Finally, the arms retract the manifold to a position below conveyor belts 52 and 53 so as to deposit bag 23 on what amounts to the input station for the bag positioning and opening assemblies, namely, horizontal conveyor means 26. The vacuum is then broken, and the horizontal conveyor commences movement of the bag away from the input station and the sequence is repeated.

The stacks of bags are always positioned against adjustment means or plate 48 so as to index them longitudinally with respect to support rollers 34 and vacuum pick-off assembly 33. Manifold 39 preferably has a plurality of openings therein so that vacuum cups 38 can be mounted in any one of a selected number of the openings. The remaining openings are closed by closure means 57 so that only the vacuum cups will pull a vacuum. The manifold structure, however, allows the cups to be positioned along the length of the manifold to enhance the suction for supply to the valve bags. It is preferable that at least two vacuum cups 38 be employed and that they further be positioned along manifold 39 so that they apply suction to the end flaps 58 and 59 (FIGS. 5 and 6) of the bag. End flaps 58 and 59 tend to be the most rigid portion of the bag, and accordingly, pulling the end flaps down from about the midpoint of the width of the bag will cause the bag to bow relatively uniformly as the bag is pulled past support rollers 34 and 36. It is possible, although not usually required, to employ vacuum cups intermediate the cups which apply vacuum force to the end flaps of the bag.

Figure 2:
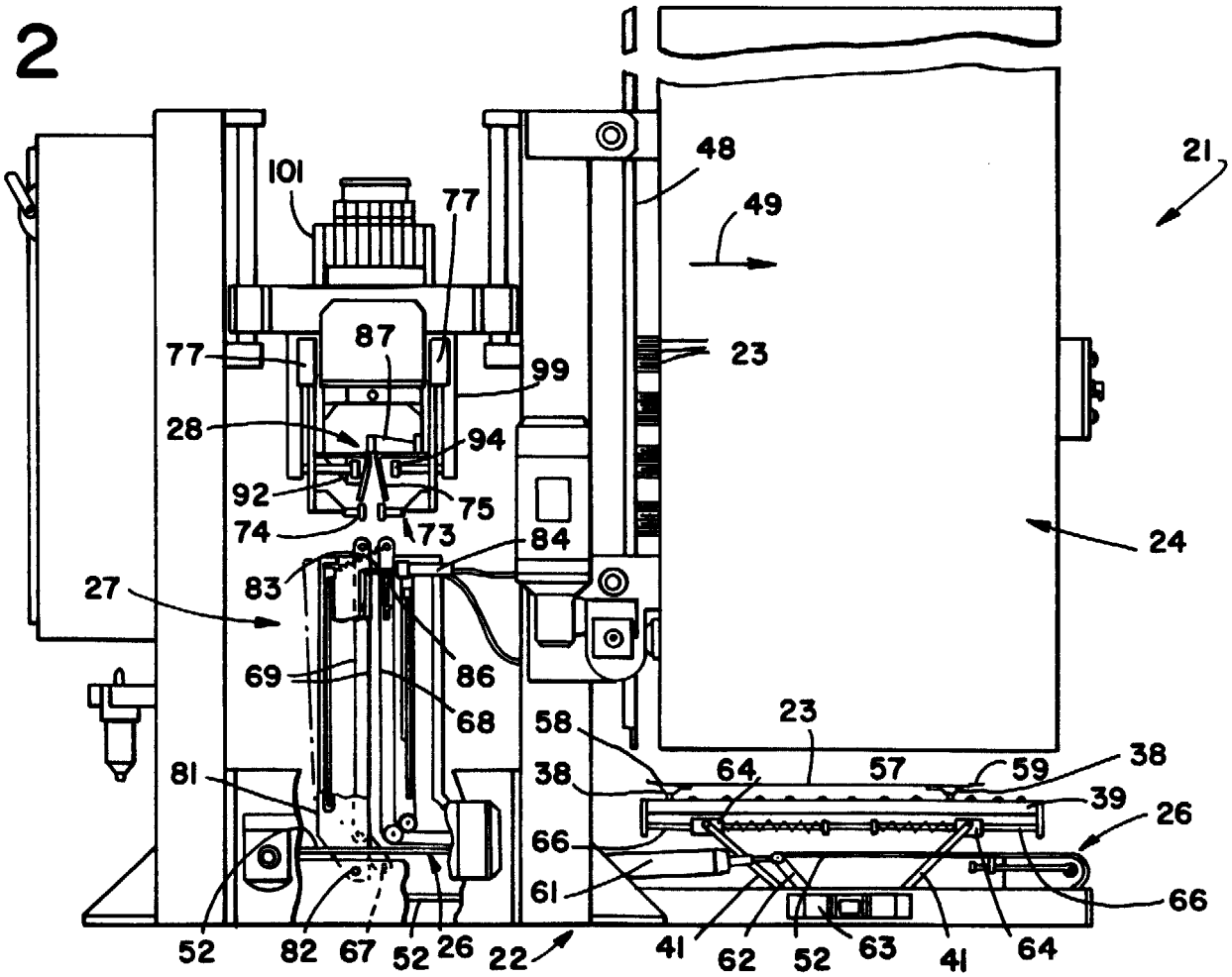
FIG. 2 is a side-elevational view, partially broken away, of the valve bag placer of FIG. 1.

As best may be seen in FIG. 2, pneumatic cylinder 61 can be used to drive lever 62 which in turn is coupled to gear means 63 for raising and lowering of arms 41. Preferably, arms 41 are provided at their upper ends with slides 64 which ride guide bar or rod 66. This structure will cause the vacuum manifold to move up and down in a substantially horizontal orientation so that both vacuum cups 38 engage and draw a vacuum against a lowermost bag in the horizontal stack of bags 42 and the withdrawn bag is placed evenly on horizontal conveyor means 26.

From the input station of horizontal conveyor means 26 the bags are sequentially conveyed to vertical conveyor means 27. A guide or deflector 67 positioned between belts 52 and 53 guides or deflects the bag from horizontal conveyor means 26 upwardly between belts 68 and 69 of vertical conveyor means 27.

Figure 7:
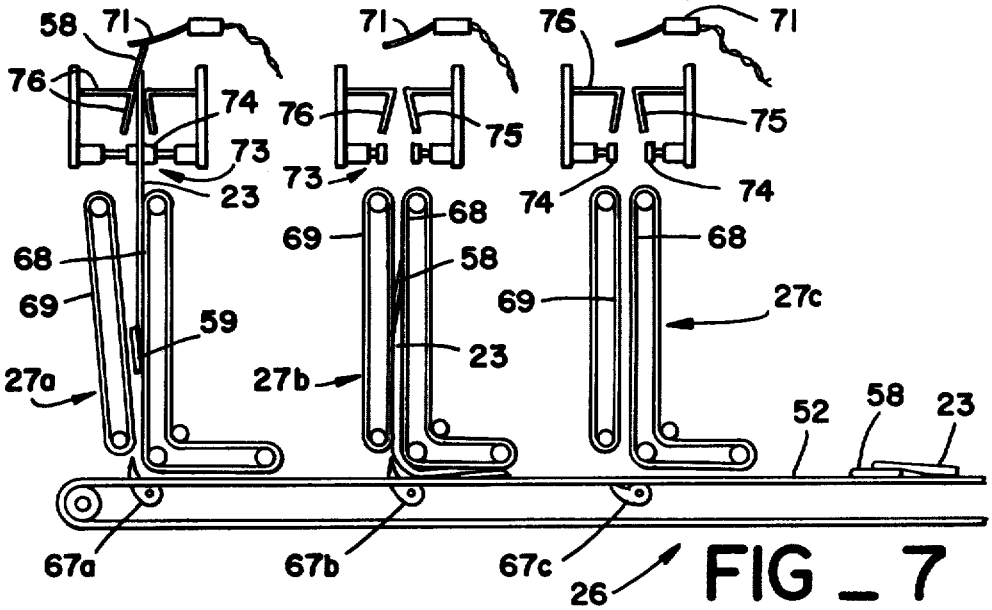
FIG. 7 is a fragmentary, side-elevational view of a modified schematic representation of three vertical conveyors ganged together and corresponding to FIG. 2.

FIG. 7 shows an alternative embodiment in which three vertical conveyors **27*a*, 27*b* and 27*c* are fed from a single horizontal conveyor 26. In such an arrangement, a plurality of guides or deflectors 67*a*, 67*b* and 67*c* are provided, with deflector 67*b* and 67*c* being selectably movable between the position of deflector 67*c* and the position of deflector 67*b* so as to permit passage of bags 23** thereover or deflection of the bags up into the vertical conveyor.

Vertical conveyor 27 is operated intermittently, as will be described more fully hereinafter. Accordingly, a single pick-off assembly 33 can remove bags from magazine 24 and place them on the input station for horizontal conveyor 26 faster than a single vertical conveyor can cycle through the steps which it must perform in the apparatus of the present invention. The ganging of vertical conveyors for feeding off a single horizontal conveyor, therefore, can be used to enhance the efficiency of the bag placer.

Once bag 23 has been conveyed to the position shown on the left side of FIG. 7, the uppermost end flap 58 will engage feeler switch 71 or a similar sensing device, such as a photoelectric cell, and operation of the vertical conveyor will terminate. Additionally, first clamping means 73 will be actuated and the gripping jaws 74 will grip the bag body proximate but below end flap 58. In order to guide the end flap into engagement with feeler switch 71 and position the bag body for gripping by first clamping means 73, it is preferable that a pair of flange guide members 75 and 76 be provided.

It is an important feature of the bag placer of the present invention that changes in the orientation of the bags are minimumized so that the greatest amount of control and reproducibility of operation can be achieved. Thus, in the bag placer of the present invention the bags are initially in a horizontal position and are conveyed to a vertical orientation as shown at the lefthand side of FIG. 7. Bags 23 essentially remain in the vertical orientation of FIG. 7 throughout the remainder of the bag placing process. This is accomplished in the apparatus of the present invention by mounting first clamp means 73 on laterally movable first carriage 77. Once bag 23 is gripped between jaws 74, first carriage 77 moves laterally of vertical conveyor 27, as best may be seen in FIGS. 8 through 12. Thus, first clamp means 73 moves in the direction of arrows 78 toward flap orienting assembly 28.

In order to permit lateral displacement of the bags, vertical conveyor 27 must open up or release bag 23. This may be advantageously accomplished by pivoting frame 81 for the endless conveyor 69 at pivot point 82 (FIG. 2). Spring biasing means 83 biases the conveyor to the closed position and pneumatic cylinder 84 and piston 86 are used to open the vertical conveyor 27. The conveyor is shown in the open position on the lefthand side of FIG. 7 and in FIG. 9. It will be seen in FIG. 9 that the pivoting of conveyor 69 about the lower end thereof opens the conveyor sufficiently so that the lower end flap 59 of the bag is free for lateral displacement.

Figure 9:
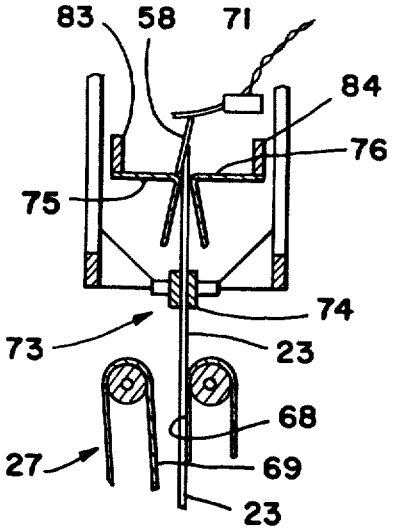
FIG. 9 is an enlarged, fragmentary, cross-sectional view taken substantially along the plane of line 9—9 in FIG. 8.

FIG. 9 shows conveyor 27 in the open position with first clamp means 73 grippingly engaging the bag body. End flap 58 is folded down against the bag body and accordingly is substantially vertically oriented when the bag reaches the position shown in FIG. 9. In order to open the bag valve contained in end flap 58, the end flap must be rotated relative to the bag body until it is approximately perpendicular to the remainder of the bag body. In the apparatus of the present invention, this is accomplished by folding the end flap, rather than manipulating the bag body, which is maintained in a vertical orientation from the vertical conveyor means 27 to the fill spigot assembly 31.

Figure 12:
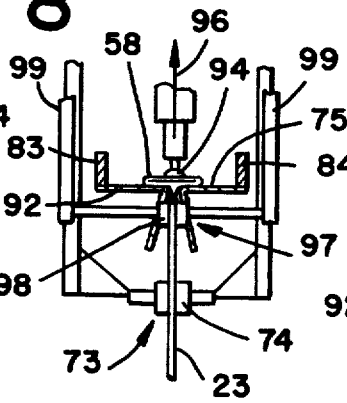
FIG. 12 is an enlarged, fragmentary, side-elevational view taken substantially along the plane of line 12—12 in FIG. 8.

The apparatus of the present invention includes a flap orienting assembly or deflector assembly 28 which is used to fold end flap 58 from the position shown in FIG. 9 to the position shown in FIG. 12. Deflector assembly 28 is formed to first rotate the uppermost portion of the end flap downwardly to the position shown in FIG. 10 and thereafter to rotate the lowermost portion of the end flap upwardly until it has reached the position shown in FIG. 11.

Figure 8:
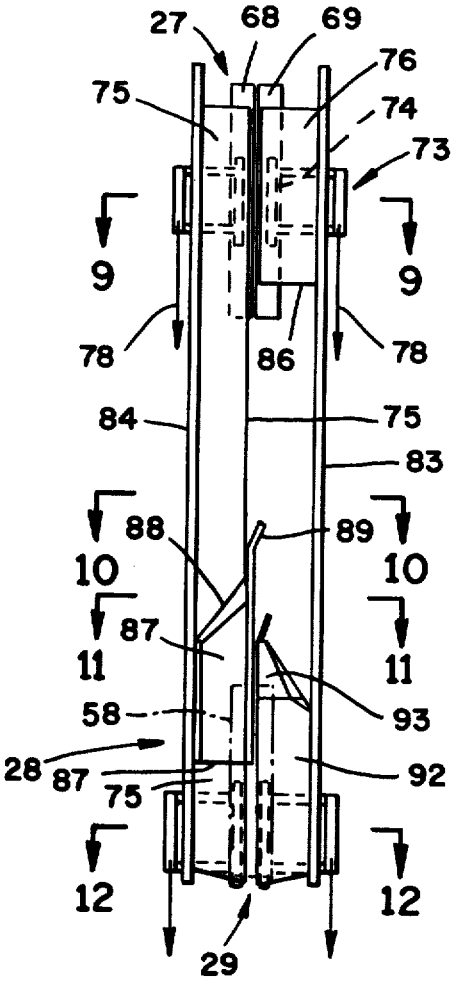
FIG. 8 is a schematic top plan view of the end flap deflecting apparatus of the bag placer of the present invention.

As shown in FIG. 8, a pair of longitudinally extending bars 83 and 84 have guide members 75 and 76 mounted thereto. Guide member 75 extends over the full length of travel of first carriage 77 to which first clamp means 73 is mounted. Thus, guide member 75 is positioned in superimposed relation to vertical conveyor means 27 so as to guide the end flap upwardly between guide member 75 and opposed guide member 76 to trigger sensing switch 71 and terminate operation of the vertical conveyor. As the carriage moves in the direction of arrows 77, guide member 75 guides and stablizes the movement of the bag body as it proceeds across the bag placer apparatus to the deflector assembly 28. Guide member 76, however, terminates at 86 since there is no need to precisely guide the bag body over the full length of travel of first carriage 77.

Figure 10:
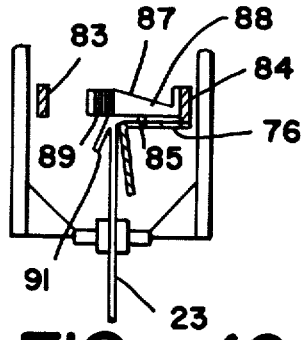
FIG. 10 is an enlarged, fragmentary, cross-sectional view taken substantially along the plane of line 10—10 in FIG. 8.
Figure 11:
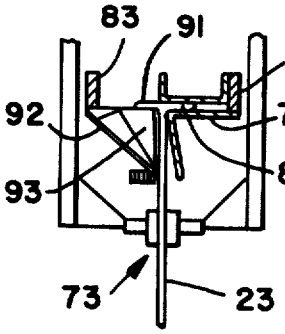
FIG. 11 is an enlarged, fragmentary, cross-sectional view taken substantially along the plane of line 11—11 in FIG. 8.

As best may be seen in FIGS. 8 and 10, first deflector element 87 is bolted to longitudinally extending bar 84 at a spaced distance above guide channel 76. Additionally, the front surface 88 is rearwardly tapered, and the first guide element is provided with a forwardly extending flange 89 which will urge the uppermost portion 85 (righthand side of the flap in FIG. 10) downwardly between first deflector element 87 and longitudinal guide member 76. During this process, the lowermost portion of the flap 91 tends to be raised or broken away from the body of bag 23 to some degree, and second deflector element 92 bolted to longitudinal bar 83 engages flap 91 along rearwardly and upwardly sloped surface 93 to fold the flap up to the position shown in FIG. 11.

If the valve bags are formed with end flaps folded against the opposite side of the bag (right side down as viewed in FIG. 2) the first and second deflector elements can be reversed. Thus, a mirror image of deflector 87 can be bolted to bar 83 and a mirror image of deflector 92 bolted to bar 84.

Figure 12A:
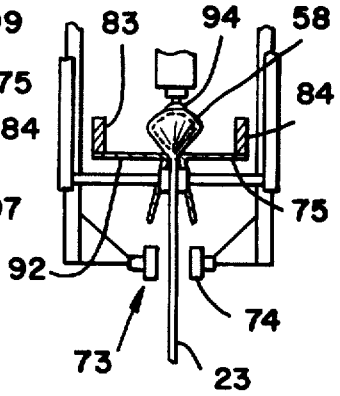
FIG. 12A is an enlarged, fragmentary, cross-sectional view corresponding to FIG. 12 showing the elements in a moved position.

When flap 58 has reached loading station 29 it is substantially perpendicularly oriented to the bag body and is supported on the upper surface of longitudinally extending flange 75 and second deflector element 92, as best may be seen in FIG. 12. The bag is now ready to be opened, and a bag opening vacuum cup 94 is automatically brought down into engagement with the upper surface of flap 58 proximate the side of the bag, and then vacuum cup 94 is retracted, as indicated by arrow 96, to the position shown in FIG. 12A to thereby open the valve in end flap 58.

At bag opening station 29 second clamping means, generally designated 97 and including clamping jaws 98, are brought into engagement with bag 23 immediately below and proximate end flap 58. Second clamp means 97 is suspended by arms 99 from movable second carriage 101 that is mounted for guided reciprocation on track or rail means 102 (FIG. 1). As best may be seen in FIG. 1, flange 75 is formed with a notch 103 which allows gripping jaw 98 to engage bag 23 immediately below flap 58 and preferably above jaws 74 of first clamping means 73. Second deflector element 92 is formed with a similar notch.

Bag 23 is transferred at bag opening station 29 from first carriage 77 and first clamp means 73 to second carriage 101 and second clamp means 97. The sequence of this transfer is for the first carriage 77 to stop at opening station 29. Second clamp means then engages the bag body immediately below end flap 58. Vacuum cup 94 can then be engaged with the top surface of flap 58 and then retracted to the position shown in FIG. 12A. First clamp means 73 can open either before or after retraction and opening of the bag valve. Once first clamp means 73 is open, carriage 77 reciprocates back to its position above vertical conveyor 27. The bag is now gripped by second clamp 97 carried on carriage 101, and while the valve is in the open position, the carriage proceeds in the direction of arrow 104 in FIG. 1 until the bag is positioned over fill spigot 106, as shown in phantom.

As is common in the industry, the filling apparatus 107 rapidly fills product into bag 23, and a tilt weighing support 108 supports the bag together with clamping means 97 until it is filled. When the bag is filled, clamp 97 releases and returns to the position shown in solid lines in FIG. 1. The bag then tilts on support 108 and falls in the direction of arrow 109 onto conveyor 32. As the bag falls away from spigot 106, the valve in end flap 58 automatically closes.

As will be readily understood, the sequencing of the bag pick-off, vertical conveyor operation, and two carriages can be controlled and operated by a variety of electrical, pneumatic and hydraulic apparatus, but is preferable when using vacuum cups for the pick-off and valve opening operation of the various apparatus be controlled through pneumatic actuators and valving.

What is claimed is:

1. An automatic valve bag placer for opening and sequential positioning of valve bags for filling through a fill spigot, said valve bags each including an end flap folded against the bag body and a fill valve mounted in said end flap; and said valve bag placer including, a flap orienting assembly formed for rotation of said end flap to a position for opening of said valve, a bag feeding assembly formed to feed individual bags sequentially to said orienting assembly, a bag opening and filling assembly formed to open said valve after orientation by said orienting assembly and formed to displace one of said bags and said fill spigot to a position for filling of said bag, wherein the improvement in said valve bag placer comprises:

said flap orienting assembly including first clamp means formed to selectively grip and release said bags at a spaced distance below said end flap while positioned in said bag feeding assembly, deflector means formed to rotate said end flap to said position for opening of said valve, and first carriage means having said first clamp means mounted thereto for lateral displacement of said bag to remove said bag from said bag feeding assembly and to displace said end flap against said deflector means for cooperative engagement therewith to rotate said end flap to a position for opening of said valve; and said bag opening and filling assembly including second clamp means formed to selectively grip and release said bag immediately below and proximate said end flap, second carriage means having said second clamp means mounted thereto, and valve opening means carried by said second carriage means and movably mounted to engage said end flap and to open said valve, said second clamp means and said valve opening means being formed to cooperate to hold said valve in an open condition and said second carriage means being formed for lateral displacement of said bag and insertion of said fill spigot into the open valve.

2. The valve bag placer as defined in claim 1 wherein, said bag feeding assembly includes vertical conveyor means formed to feed said bags sequentially to a vertically extending position proximate said flap orienting assembly, said vertical conveyor means being futher formed for release and removal of valve bags therefrom from a side thereof, and said first clamp means is formed to grip said bag while positioned in said vertical conveyor means and displace said bag laterally from said side of said vertical conveyor means.

3. The valve bag placer as defined in claim 1 wherein, said bag feeding assembly includes a bag magazine formed for stacking of a plurality of valve bags therein in a generally horizontal orientation, said magazine being further formed for supporting a stack proximate the bottom thereof with an opening for removal of the lowermost bag of said stack, and pick-off means formed and positioned to grip the lowermost bag and remove said lowermost bag from said magazine by displacement of the same sustantially vertically down through said opening.

4. The valve bag placer as defined in claim 3 wherein, said bag feeding assembly further includes horizontal conveyor means positioned below said magazine and extending to said vertical conveyor means, said pick-off means being further formed to sequentially deposit said bags removed from said magazine onto said horizontal conveyor, and guide means formed to guide the displacement of said bags from said horizontal conveyor means to said vertical conveyor means.

5. The valve bag placer as defined in claim 4 wherein, said horizontal conveyor means and said vertical conveyor means are coupled together for controlled intermittent operation.

6. The valve bag placer as defined in claim 2 wherein, said vertical conveyor means is formed by a pair of opposed endless belt assemblies mounted for advancement of said bags therebetween and at least one of said belt assemblies is mounted for selective displacement away from a remainder of said belt assemblies to enable release of said bags therefrom.

7. The valve bag placer as defined in claim 6 wherein, at least one of said endless belt assemblies is mounted for pivotal displacement about a lower end thereof for release of said bags, said endless belt assemblies being formed to advance said bags vertically to a position at which the lowermost end of said bags is free for lateral displacement from between said belt assemblies upon pivoting of said one of said belt assemblies.

8. The valve bag placer as defined in claim 1 wherein, said deflector means is formed to first rotate downwardly an upper edge of said end flap and thereafter to rotate upwardly a lower edge of said end flap during lateral displacement of said first clamp means.

9. The valve bag placer as defined in claim 8 wherein, said flap orienting assembly further includes support plate means for receipt and lateral support of the body of a bag formed with a pair of opposed vertically extending surfaces defining a space therebetween dimensioned for receipt of the body of a bag and a pair of horizontally extending surfaces formed and positioned for support of the underside of said end flap when oriented perpendicularly to said bag body, said support plate means being positioned laterally of said deflector means on a side thereof remote from said vertical conveyor means.

10. The valve bag placer as defined in claim 1 wherein, said second clamp means being mounted to said second carriage means for gripping of said bag above said first clamp means, and said first clamp means being formed for release of said bag upon gripping by said second clamp means.

11. A deflector assembly for use in opening valve bags in an automatic valve bag placer apparatus, said valve bags each having a bag body and an end flap folded against said bag body and formed with a valve therein, said bag placer apparatus having means for gripping and displacing said valve bags for cooperative engagement of said valve bags with said deflector assembly during displacement to position said end flap for opening of said valve, wherein the improvement in said deflector assembly is comprised of:

said deflector assembly being formed to first rotate the uppermost portion of said end flap downward and to thereafter rotate the lowermost portion of said end flap upwardly until said end flap is oriented at about 90° to said bag body.

12. A deflector assembly as defined in claim 11 wherein, said deflector assembly is formed to first engage said lowermost portion after at least about 45° of downward rotation of said uppermost portion of said end flap.

13. A deflector assembly as defined in claim 11 wherein, said means for gripping and displacing said valve bags is formed for displacement of said valve bags in a direction laterally along said end flap while said valve bags are oriented in a substantially vertical orientation, said deflector assembly includes a first deflector element positioned to engage and rotate said uppermost portion of said end flap, and a second deflector element positioned in spaced apart relation to said first deflector element and positioned to engage and rotate said lowermost portion of said end flap.

14. A deflector assembly as defined in claim 12 wherein, said deflector assembly further includes opposed inverted L-shaped support plates separated by a distance slightly greater than the thickness of the body of said valve bags, said first and second deflector elements being mounted relative to said support plates for rotation of said flap to a position causing said bag body to be positioned between said L-shaped support plates with said end flap supported on the perpendicular legs of said support plates.

15. A deflector assembly as defined in claim 11 wherein, said deflector assembly is formed for selective mounting to said valve bag placer apparatus in positions enabling rotation of end flaps folded to either side of said bag body.

* * * * *